US006722034B2

(12) United States Patent
Enomoto et al.

(10) Patent No.: US 6,722,034 B2
(45) Date of Patent: Apr. 20, 2004

(54) METHOD OF CONNECTING CABLE TO CONNECTOR

(75) Inventors: Noritsugu Enomoto, Tokyo (JP); Yoshiyuki Suzuki, Tokyo (JP); Kazumasa Sakata, Tokyo (JP); Kazunori Saka, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 10/142,528

(22) Filed: May 8, 2002

(65) Prior Publication Data

US 2002/0173196 A1 Nov. 21, 2002

(30) Foreign Application Priority Data

May 21, 2001 (JP) ..... 2001-151338
Oct. 18, 2001 (JP) ..... 2001-320855
Nov. 9, 2001 (JP) ..... 2001-344930

(51) Int. Cl.[7] ..... H01R 43/04
(52) U.S. Cl. ..... 29/863; 29/861; 29/865
(58) Field of Search ..... 29/836, 857, 861, 29/863, 865, 866

(56) References Cited

U.S. PATENT DOCUMENTS 3,697,925 A * 10/1972 Henschen
3,924,917 A * 12/1975 Munshower

FOREIGN PATENT DOCUMENTS

| | | |
|---|---|---|
| EP | 1261081 A2 * | 11/2002 |
| JP | 63-281071 | 11/1988 |
| JP | 10-125437 | 5/1998 |

* cited by examiner

*Primary Examiner*—Carl J. Arbes
(74) *Attorney, Agent, or Firm*—Knobbe, Martens, Olson & Bear, LLP

(57) ABSTRACT

A method of connecting a flat cable having flat conductors arranged in parallel and covered with an insulating material to a connecting terminal, in which crimp pieces of the connecting terminal are pierced into a desired conductor of conductors of the flat cable, with a gap left between a substrate of the connecting terminal and the flat cable, and leading ends of the crimp pieces penetrating the flat cable are bent inwardly, while maintaining a contact position of the crimp pieces penetrating the conductor and the conductor unchanged. Also disclosed are an apparatus for embodying the connecting method and a method for determining a connecting state between the flat cable and the connecting terminal.

7 Claims, 9 Drawing Sheets

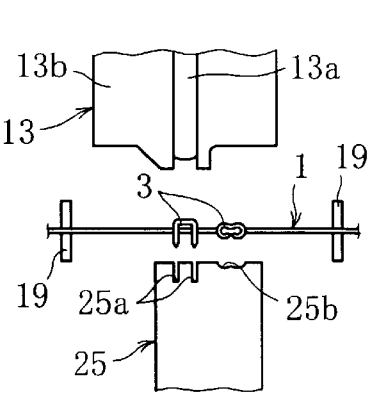
FIG. 3A
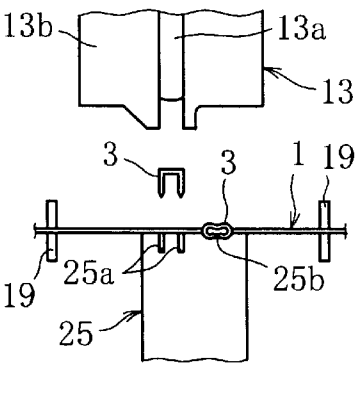
FIG. 3B
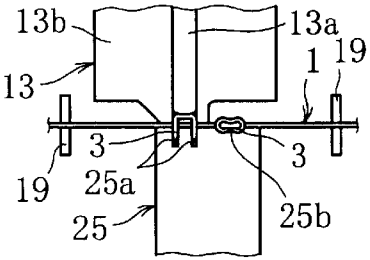
FIG. 3C
FIG. 3D
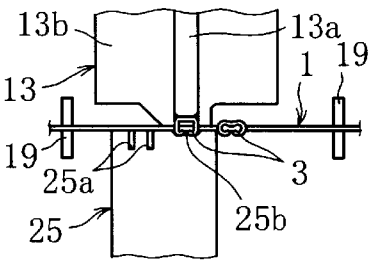
FIG. 3E
FIG. 3F
FIG. 3G

METHOD OF CONNECTING CABLE TO CONNECTOR

FIELD OF THE INVENTION

The present invention relates to a method of connecting a flat cable to a connecting terminal, a connecting apparatus, and a connecting state determining method.

BACKGROUND OF THE INVENTION

A conventional wire harness for use in a vehicle is typically comprise of wires each having a conductor of circular shape in cross-section covered with an insulating material. To establish electrical connections between wires of a wire harness or between wires and vehicle-mounted electrical equipment units, connecting terminals are attached to the conductors of the wires by means of crimping or insulation displacement.

To determine pass/fail of a crimping state or an insulation displacement state of the connecting terminal with the conductor, a method is known which takes advantage of a load pattern that changes with time during an operation of attaching a connecting terminal to a wire (Japanese Unexamined Patent Publications Nos. Sho 63-281071, Hei 10-125437). Based on such a determining method, a quality control system has also been established.

In recent years, with the trend of a complicated installation of wires and a reduction in size of connecting terminals, flat cables have been used in place of the conventional wire harnesses, and new connecting terminals called pierce terminals have been used corresponding to the flat cables.

The flat cable used in place of the wire harness is utilized in a module which is disposed in a narrow space or integrated with a vehicle component such as ceiling, door, and dash board. As shown in FIG. 17, a flat cable 1 has flat conductors 1*a* arranged in parallel and covered with an insulating material 1*b*. The conductors 1*a* are made, for example, of copper, aluminum or the like of 0.15 to 0.2 mm in thickness and approximately 1.5 to 2.5 mm in width Wc. The insulating material 1*b* is, for example, a polyethylene terephthalate (PET) film of 0.09 mm in thickness, or a less expensive polybuthylene terephthalate (PBT), or the like.

As shown in FIG. 18, a connecting terminal 3 has crimp pieces 3*b* arranged to opposite to one another on both sides of a substrate 3*a* and is provided at one end with a female terminal 3*c*. The substrate 3*a* is slightly narrower than the conductor 1*a* in width Wt which is set, for example, in a range of approximately 1.2 to 2.0 mm. FIG. 19 shows a connecting terminal 5 which has a female terminal 5*c* and crimp pieces 5*b* alternately arranged on a substrate 5*a*.

To connect the connecting terminal 3 to the flat cable 1, the crimp pieces 3*b* are pierced into a desired conductor 1*a* at desired positions, and the leading ends of the penetrating crimp pieces 3*b* are bent inward in an arc shape to hold the desired conductor therebetween. In this way, the connecting terminal 3 is electrically connected to the desired conductor 1*a* of the flat cable 1.

The flat cable 1 having the connecting terminal 3 connected to the desired conductor 1*a* in the above manner poses a problem that an electrical connection between the conductor 1*a* and the crimp pieces 3*b* is not stable, thus entailing a variation. In addition, with regard to the connection with the flat cable 1 and the connecting terminal 3, no method has been established for determining pass/fail of the connection, although a determination method is established for the conventional connecting terminal. Thus, the provision of a method of determining a connecting state has been desired.

SUMMARY OF THE INVENTION

It is an object of the present invention to provide a method of connecting a flat cable to a connecting terminal, which achieves a stable electrical connection between a conductor of the flat cable and crimp pieces of the connecting terminal, a connecting apparatus, and a connecting state determining method.

To achieve the above object, according to one aspect of the present invention, there is provided a method of connecting a flat cable to a connecting terminal, in which the flat cable having a plurality of flat conductors, arranged in parallel and having surfaces thereof covered with an insulating material, is connected to the connecting terminal, by piercing a plurality of crimp pieces, formed integrally with a substrate of the connecting terminal, into a desired conductor of the flat cable and by inwardly bending leading ends of the crimp pieces penetrating the flat cable to hold the desired conductor therebetween. The method comprising the steps of piercing the crimp pieces into the desired conductor with a gap left between the substrate and the flat cable, and bending the leading ends of the crimp pieces while maintaining a contact position unchanged at which each of the crimp pieces penetrating the conductor is in contact with the conductor.

Preferably, the crimp pieces are urged simultaneously from the substrate and from the leading ends of the crimp pieces when the leading ends are bent.

Preferably, an urging force for urging the substrate is set to be larger than an urging force for urging the leading ends of the crimp pieces.

According to another aspect of the present invention, there is provided a method of connecting a flat cable to a connecting terminal, in which the flat cable, having a plurality of flat conductors arranged in parallel and having surfaces thereof covered with an insulating material, is connected to the connecting terminal, by piercing a plurality of crimp pieces, formed integrally with a substrate of the connecting terminal, into a desired conductor of the flat cable and by inwardly bending leading ends of the crimp pieces penetrating the flat cable to hold the desired conductor therebetween. The method comprises the step of forming cut ends in the desired conductor by means of the plurality of crimp pieces pierced into the desired conductor, each cut end extending along an inner face of a corresponding one crimp piece and in contact with the inner face with a constant contact pressure over substantially the entire length of the cut end.

According to a further aspect of this invention, there is provided a method of connecting a flat cable to a connecting terminal, in which the flat cable, having a plurality of flat conductors arranged in parallel and having surfaces thereof covered with an insulating material, is connected to the connecting terminal, by piercing a plurality of crimp pieces, formed integrally with a substrate of the connecting terminal, into a desired conductor of the flat cable and by inwardly bending leading ends of the crimp pieces penetrating the flat cable to hold the desired conductor therebetween. The method comprises the steps of forming cut ends in the desired conductor by means of the plurality of crimp pieces pierced into the desired conductor, each cut end extending along an inner face of a corresponding one crimp piece and in contact with the inner face with a constant pressure over substantially the entire length of the cut end, and inwardly bending the leading ends of the crimp-pieces penetrating the flat cable, while maintaining a contact state of the cut ends with the crimp pieces unchanged.

According to another aspect of the present invention, there is provided a connecting apparatus for connecting a flat cable to a connecting terminal, in which the connecting apparatus connects a flat cable having a plurality of flat conductors arranged in parallel and having surfaces covered with an insulating material to a connecting terminal by piercing a plurality of crimp pieces, formed integrally with a substrate of the connecting terminal, into a desired conductor of the flat cable, and by inwardly bending leading ends of the crimp pieces penetrating the flat cable to hold the desired conductor therebetween. The connecting apparatus comprises a receptacle on which the flat cable held at a predetermined position is placed, the receptacle having a pair of receiving grooves for receiving the crimp pieces, and a bending recess for bending the leading ends of the crimp pieces; an urging member having an urging tool, disposed opposite the receptacle with the flat cable interposed therebetween, for urging the substrate of the connecting terminal, and a guide member for guiding movements of the urging tool; first driving means having elevating means for moving the receptacle up and down, and a moving means for moving the receptacle to selectively place the receiving groove or the bending recess of the receptacle to opposite the connecting terminal; second driving means for urging the urging tool toward the substrate; and control means for controlling the operation of the connecting apparatus.

Preferably, the receptacle has a partition formed with the pair of receiving grooves, and the partition comprises a pressurizing incline plane at an entrance of each of the receiving grooves for forming cut ends in the desired conductor by means of the crimp pieces pierced into the desired conductor, each cut end extending along an inner face of a corresponding one crimp piece and in contact with the inner face with a constant contact pressure over substantially the entire length of the cut end.

Preferably, the urging member comprises a first sensor for detecting a load acting on the crimp pieces when the substrate is urged by the urging tool to pierce the crimp pieces into the flat cable, and a second sensor for detecting a displacement amount of the crimp pieces with a movement of the urging tool, wherein information detected by both the sensors is output to the control means.

Preferably, the control means receives load information from the first sensor and displacement amount information from the second sensor, and determines a connecting state of the crimp pieces to the conductor when the flat cable is connected to the connecting terminal.

Preferably, the receptacle comprises a top dead center position adjusting mechanism for adjusting a top dead center position of the receptacle.

Preferably, the urging member comprises a bottom dead center position adjusting mechanism for adjusting a bottom dead center position of the urging tool.

According to another aspect of this invention, there is provided a connecting state determining method for determining a connecting state of a connecting terminal to a flat cable having a plurality of flat conductors arranged in parallel and having surfaces thereof covered with an insulating material, in which the connecting state is determined when a desired conductor of the flat cable is connected to the connecting terminal by piercing a plurality of crimp pieces formed integrally with a substrate of the connecting terminal into the desired conductor and by inwardly bending leading ends of the crimp pieces penetrating the flat cable to hold the desired conductor therebetween. The connecting state determining method comprises the step of determining the connecting state of the crimp pieces to the desired conductor by comparing a piercing load determined when the crimp pieces are pierced into the flat cable and a normal piercing load determined in advance and observed when crimp pieces are normally pierced into a flat cable.

Preferably, the piercing load is determined based on a difference between a maximum load and a minimum load acting on the crimp pieces measured when the crimp pieces are pierced into the flat cable, the minimum load being measured after the maximum load is reached.

The foregoing and other objects, features and advantages of the present invention will become more apparent from the following detailed description based on the accompanying drawings.

BRIEF DESCRIPTION OF THE DRAWINGS

FIGS. 3A to 3G are process charts for explaining a method of connecting a flat cable to a connecting terminal according to a first embodiment of the present invention, showing a process of connecting the flat cable to the connecting terminal using the connecting apparatus of FIG. 1;

DETAILED DESCRIPTION

In the following, a method of connecting a flat cable to a connecting terminal, a connecting apparatus, and a connecting state determining method according to one embodiment of the present invention will be described in detail with reference to FIGS. 1 through 16.

Figure 1:
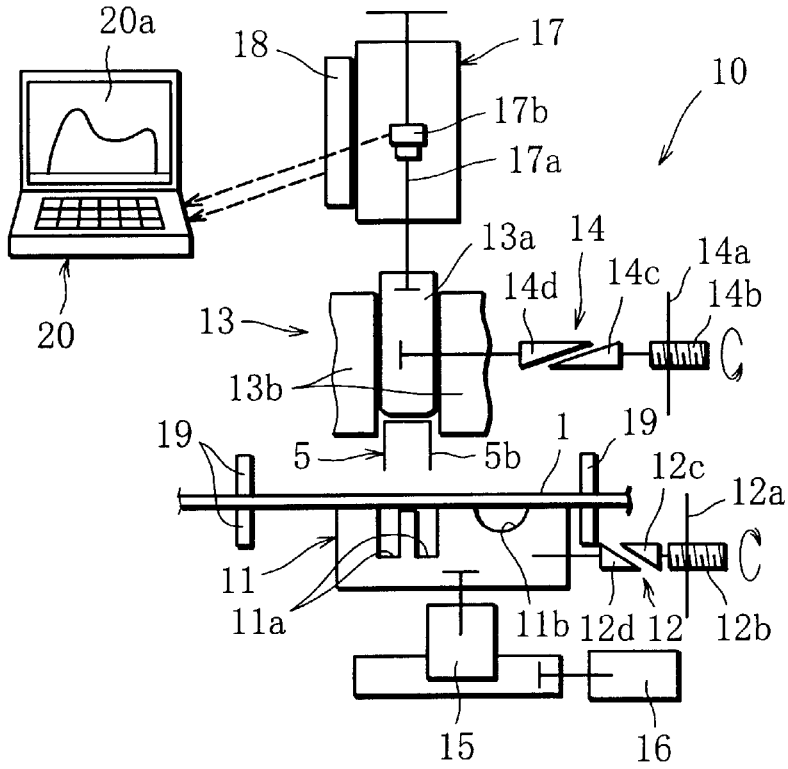
FIG. 1 is diagram generally showing a connecting apparatus for connecting a flat cable to a connecting terminal.

First, the connecting apparatus for embodying the method of connecting a flat cable to a connecting terminal will be described with reference to FIG. 1.

The connecting apparatus 10 comprises a receptacle 11; an urging member 13; a first elevating press 15; a switching cylinder 16; a second elevating press 17; and a controller 20. The apparatus 10 is used for connecting a connecting terminal 3 or 5 to a desired conductor 1*a* of a flat cable 1.

The receptacle 11 is formed with a pair of receiving grooves 11*a* for receiving a plurality of crimp pieces 5*b* provided on respective sides of the connecting terminal 5; and bending recesses 11*b* for bending leading ends of a plurality of crimping pieces 5*b*. The receptacle 11 comprises a top dead center adjusting mechanism 12. The receptacle 11 is arranged below the flat cable 1 held by left and right chucks 19.

Figure 2:
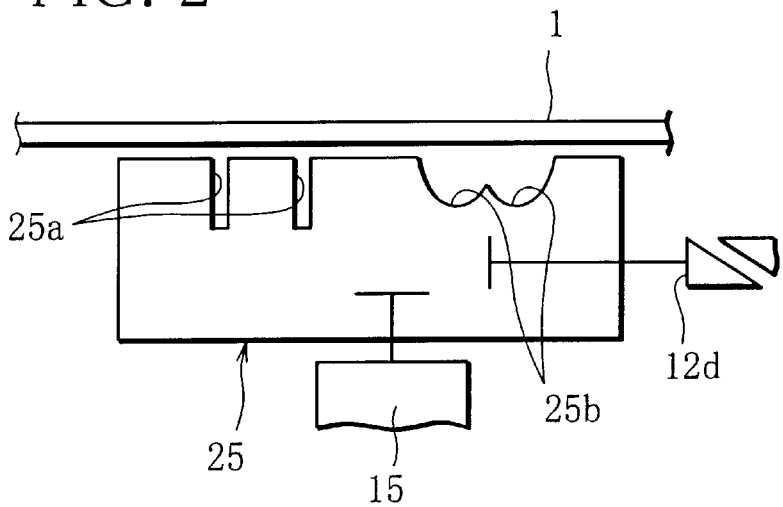
FIG. 2 is a front view of another receptacle for use in the connecting apparatus of FIG. 1.
Figure 18:
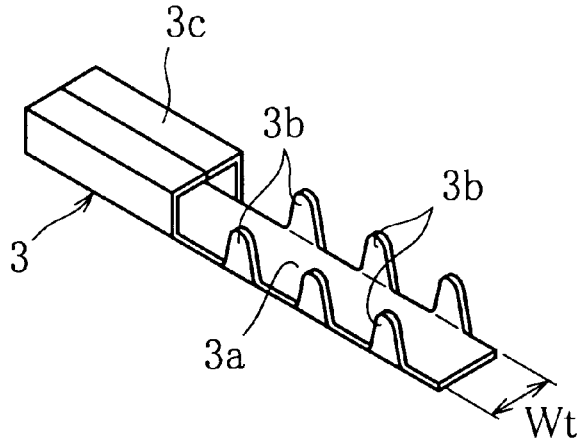
FIG. 18 is a perspective view of a connecting terminal.
Figure 19:
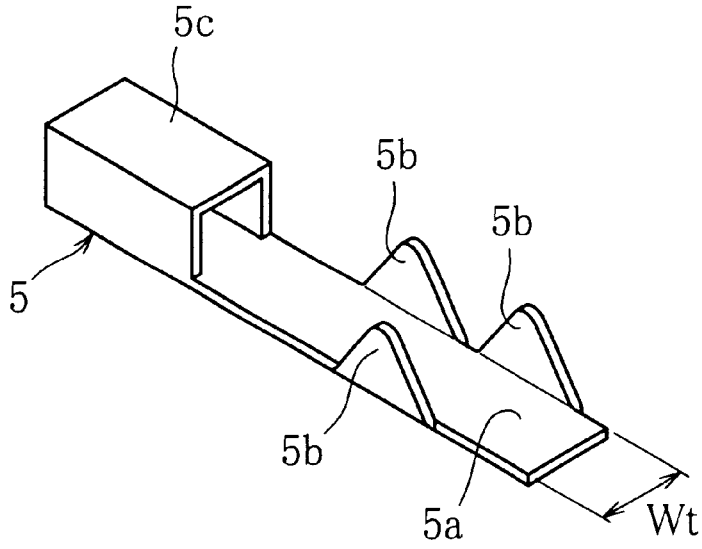
FIG. 19 is a perspective view of another connecting terminal.

The receptacle 11 is employed for the connecting terminal 5 shown in FIG. 19 which has crimp pieces 5*b* alternately arranged thereon. A receptacle 25 is used for the connecting terminal 3 shown in FIG. 18 which has crimp pieces 3*b* arranged opposite to each other. As shown in FIG. 2, the receptacle 25 is formed with a pair of receiving grooves 25*a* for receiving the crimp pieces 3*b*, and two bending recesses 25*b* for bending leading ends of the crimp pieces 3*b*.

The top dead center adjusting mechanism 12, which adjusts the top dead center of the receptacle 11, has an adjusting screw 12*b* screwed into a cramping member 12*a*; a top dead center setting member 12*c* having a tapered bottom surface; and a stopper member 12*d* having a tapered top surface. As the adjusting screw 12*b* is rotated, the top dead center setting member 12*c* moves horizontally, to change a position at which the tapered surface of the stopper member 12*d* is in contact with the tapered surface of the top dead center setting member 12*c*, to thereby adjust a vertical position of the receptacle, i.e., a position of the receptacle relative to the top dead center of the receptacle 11.

The urging member 13, arranged opposite to the receptacle 11 with a flat cable 1 interposed therebetween, has an urging tool 13*a* and a guide member 13*b*, and is provided with a bottom dead center adjusting member 14 for adjusting the bottom dead center of the urging tool 13*a*. The urging tool 13*a* urges a substrate 5*a* of the connecting terminal 5. The guide member 13*b* guides movements of the urging tool 13*a*.

The bottom dead center adjusting mechanism 14 has an adjusting screw 14*b* screwed into a cramping member 14*a*; a top dead center setting member 14*c* having a tapered top surface; and a stopper member 14*d* having a tapered bottom surface. Similar to the top dead center adjusting mechanism 12, the adjusting mechanism 14 adjusts a vertical position of the stopper member 14*d*, i.e., a position thereof relative to the bottom dead center of the urging tool 13*a*.

The first elevating press 15 moves up and down the receptacle 11 with respect to the flat cable 1.

The switching cylinder 16 moves the first elevating press 15 in the horizontal direction together with the receptacle 11 to selectively dispose the receiving grooves 11*a* or bending recesses 11*b* to a position opposite to the urging tool 13*a*.

The second elevating press 17 is an actuator for moving the urging tool 13*a* up and down, and is provided with a load cell 17*b* on a rod 17*a* coupled to the urging tool 13*a*. A displacement amount sensor 18 is disposed in the vicinity of the press 17. The load cell 17*b* detects a load acting on the crimp pieces 3*b* or 5*b* when the crimp pieces are pierced into the flat cable 1. The displacement amount sensor 18 reads the amount of movement of the load cell 17*b* by means of a photosensor, thereby detecting a displacement amount of the crimp pieces 3*b* or 5*b* when the urging tool 13*a* urges the substrate 3*a* or 5*a*. Alternatively, the sensor 18 may be provided with a mechanism for mechanically rotating the rod 17*a* for moving the same up and down and may determine, from the rotational speed of the rod 17*a*, a feed amount of the rod 17*a* as the displacement amount of the crimp pieces 3*b* or 5*b*.

In the embodiment, the load cell 17*b* is used to sense a load and the displacement amount sensor 18 is used to detect a displacement amount, but other sensors may be used, such as a piezoelectric transducer element, a capacitive element, and the like.

The controller 20, comprised of a personal computer and receiving electric signals related to a load and a displacement amount detected by the load cell 17*b* and displacement amount sensor 18, controls the operation of the connecting apparatus 10 and determines a connecting state of the flat cable 1 to the connecting terminal 3 or 5. The controller 20 displays a change in a load acting on the crimp pieces 3*b* or 5*b* to a displacement amount of the crimp pieces 3*b* or 5*b* on a monitor 20*a* based on the electric signals related to the load and displacement amount output from the load cell 17*b* and displacement amount sensor 18. The controller 20 determines, as described later, a connecting state based on a piercing load (i.e., a difference between a maximum load and a minimum load) acting on the crimp pieces 3*b* or 5*b* when the crimp pieces are pierced into the flat cable 1. A load acting on the crimp pieces varies as a function of displacement of the crimp pieces pierced into the flat cable.

The connecting apparatus 10 configured in the above manner is used to connect the connecting terminal 3 or 5 to the flat cable 1 in a connecting method described below.

In the following, a method of connecting a flat cable to a connecting terminal according to a first embodiment of the present invention will be described with reference to FIGS. 3 through 9. The connecting apparatus 10 uses the receptacle 25 in place of the receptacle 11.

Figure 4:
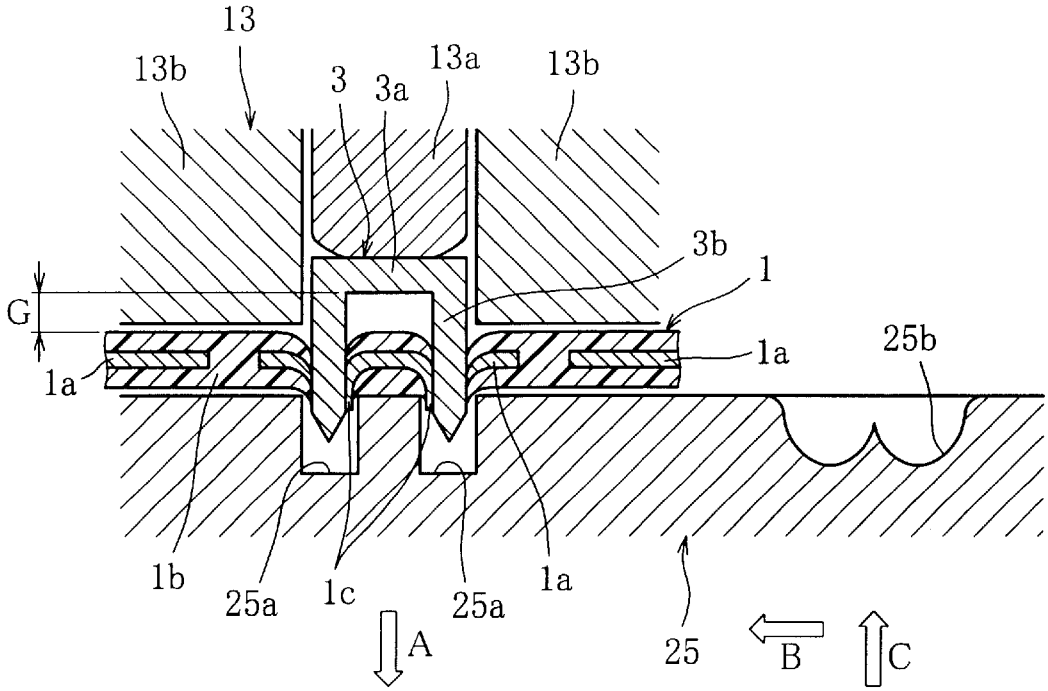
FIG. 4 is a cross-sectional view showing how a connecting terminal is pierced by an urging member utilizing a receptacle.

First, as shown in FIG. 3A, a flat cable 1 and a connecting terminal 3 are disposed at predetermined positions between the urging member 11 and receptacle 25. As shown in FIG. 4, the flat cable 1 is placed on the receptacle 25, and a desired conductor 1*a* to be connected is positioned in alignment with the pair of receiving grooves 25*a*. The flat cable 1 is held by the chucks 19 on both sides of the receptacle 25, as shown in FIG. 1. The connecting terminal 3 is coupled to a coupling piece (not shown) which is supported by a supporter (not shown).

Next, as shown in FIG. 3B, the receptacle 25 is moved up in contact with the bottom surface of the flat cable 1. At this time, the plurality of crimp pieces 3*b* oppose the pair of receiving grooves 25*a*.

Next, as shown in FIG. 3C, the urging member 13 is moved down while the urging tool 13*a* is pressed down by the second elevating press 17 with the guide member 13*b* serving as a guide. In this way, the urging tool 13*a* urges the substrate 3*a* to pierce crimp pieces 3*b* into the flat cable 1. As a result, the flat cable 1 is formed at the conductor 1*a* with cut ends 1*c* by means of piercing crimp pieces 3*b*. The cut ends 1*c* extend along the inner faces, opposite to each other, of the crimp pieces 3*b* and are in contact with the inner faces of the crimp pieces 3*b* with a constant contact pressure over substantially their entire length.

Figure 5:
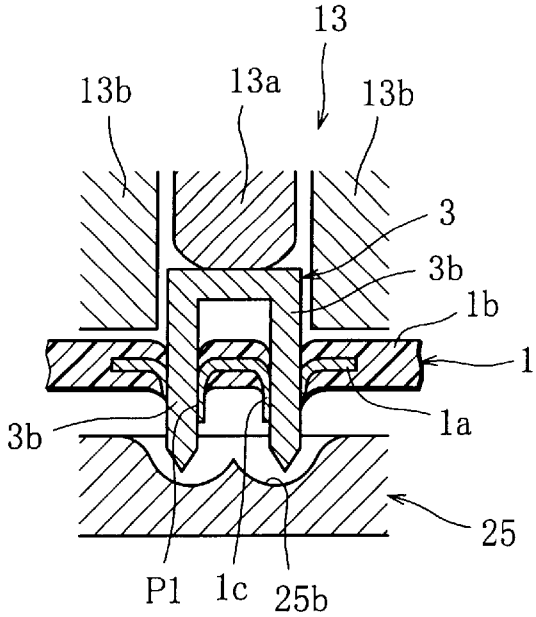
FIG. 5 is a cross-sectional view showing how leading ends of crimp pieces are bent utilizing a bending recess of the receptacle.

As shown in FIG. 4, the crimp pieces 3*b* are pierced into the conductor 1*a* with a gap G left between their A substrates 3*a* and flat cable 1. In this way, the crimp pieces 3*b* are electrically connected to the cut ends 1*c* of the conductor 1*a* at contact positions P1, as shown in FIG. 5.

Subsequently, as shown in FIG. 3D, the urging member 13 and receptacle 25 are detached from the flat cable 1 in the vertical direction. To this end, the receptacle 25 is moved down, as indicated by an arrow A in FIG. 4, by the first elevating press 15 to release the crimp pieces 3*b* from the pair of receiving grooves 25*a*. Since the flat cable 1 is held at two points by the chucks 19, the contact positions P1 of the crimp pieces 3*b* with the conductor 1*a* are kept unchanged.

Next, as shown in FIG. 3E, the receptacle 25 is moved horizontally from the position shown in FIG. 3D to place the two bending recesses 25*b* opposite to the crimp pieces 3*b*. Specifically, the receptacle 25 is moved horizontally to the left by the switching cylinder 16 as indicated by an arrow B in FIG. 4. In parallel with this, the urging member 13 is moved down to a bottom dead center PL at which the urging tool 13*a* comes in contact with the substrate 3*a*.

Next, as shown in FIG. 3F, the receptacle 25 is moved up from the position shown in FIG. 3E to a top dead center PU. More specifically, the receptacle 25 is moved upward, as indicated by an arrow C in FIG. 4, by the first elevating press 15, while maintaining the contact positions P1 of the crimp pieces 3*b* to the conductor 1*a* unchanged.

In this way, the crimp pieces 3*b* are urged simultaneously by both the urging tool 13*a* close to the substrate 3*a* and the bending recesses 25*b* close to the leading ends of the crimp pieces 3*b*. Thus, the leading ends of the crimp pieces 3*b* are bent while they are curved in an arc shape along the bending recesses 25*b*. At this time, an urging force is imparted to the urging tool 13*a* from the second elevating press 17. An urging force for urging the substrate 3*a* is set to be larger than an urging force with which the receptacle 25 urges the leading ends of the crimp pieces 3*b*.

Figure 6:
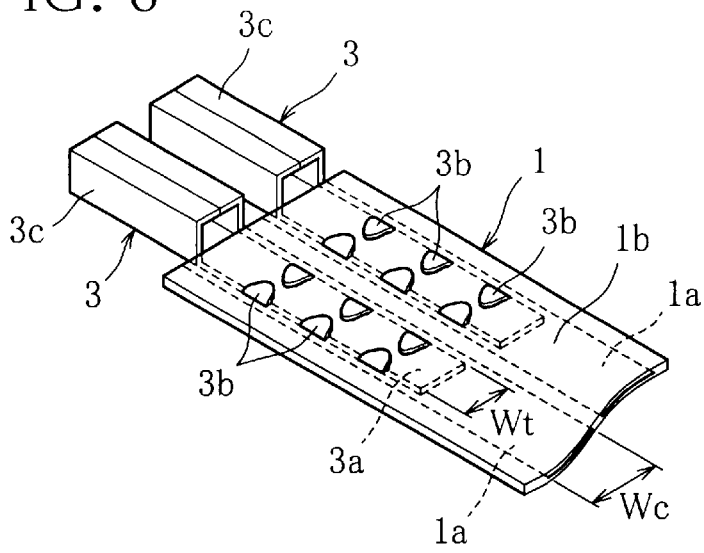
FIG. 6 is a perspective view showing an example of a flat cable to which a connecting terminal is connected.

Subsequently, as shown in FIG. 3G, the urging member 13 and receptacle 25 are detached upward from the flat cable 1, and the flat cable 1 is released from the chucks 19 to complete the operation for connecting the connecting terminal 3 to the flat cable 1. FIG. 6 shows an example of the flat cable 1 to which the connecting terminal 3 is connected in the foregoing manner.

In the meantime, only the receptacle 25 may be moved from the state shown in FIG. 3C through the steps of FIGS. 3D and 3E to the step of FIG. 3F.

Figure 7:
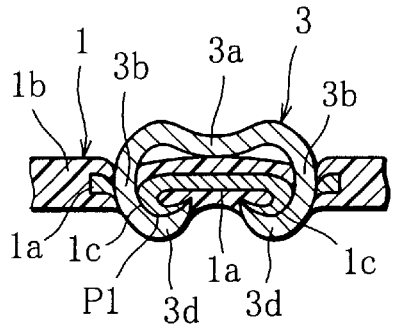
FIG. 7 is a cross-sectional view of a flat cable to which a connecting terminal is connected by bending leading ends of crimp pieces in accordance with the method of the present invention.

As a result, the flat cable 1 is connected to the connecting terminal 3, as shown in FIG. 7, and a bent portion 3*d* arcuately curved and formed at the leading end of each crimp piece 3*b* overlaps the contact position P1 at which the crimp piece 3*b* is in contact with the cut end 1*c* of the conductor 1*a*. Thus, the flat cable 1 and the connecting terminal 3 are retained in a state where a large contact load is applied to the bent portion 3*d* and the contact position P1.

More specifically, the flat cable 1 is held by the chucks 19 at two points, and the crimp pieces 3*b* are urged simultaneously from the urging tool piece 13*a* and from the leading ends of the crimp pieces 3*b*. Thus, the flat cable 1 is connected with the connecting terminal 3, while maintaining the contact position P1 of the crimp piece 3*b* and the cut end 1*c* unchanged. Therefore, the cut end 1*c* of the conductor 1*a* and the crimp piece 3*b* of the connecting terminal 3 are retained in a state they are applied with a high contact load, thereby providing a stable electric connection between the conductor 1*a* and crimp piece 3*b*.

Figure 8:
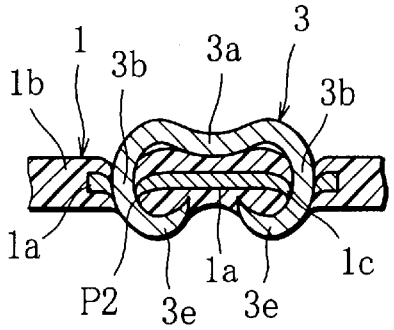
FIG. 8 is a cross-sectional view of a flat cable to which a connecting terminal is connected by bending leading ends of crimp pieces in accordance with a conventional method.

However, if the crimp pieces 3*b* are pierced into the conductor 1*a* until the substrate 3*a* comes in contact with the flat cable 1, a stable electric connection cannot be provided between the crimp pieces 3*b* and conductor 1*a*, even if the subsequent step of bending the leading ends of the crimp pieces 3*b* is performed in a manner similar to the above. Specifically, as shown in FIG. 8, the bent portion 3*e* of the crimp piece 3*b* does not overlap the contact position P2 at which the crimp piece 3*b* is in contact with the cut end 1*c* of the conductor 1*a*. For this reason, a significantly reduction is caused in contact load applied to the conductor 1*a* and the crimp piece 3*b*, thus failing to provide a stable electric connection therebetween.

In case that the crimp piece 3*b* penetrating the flat cable 1 is properly pierced into the conductor 1*a* with a gap G (=1.0 mm) left between the substrate 3*a* and flat cable 1, the leading ends of the crimp pieces 3*b* are arcuately bent, while involving the cut end 1*c*, with the bent portion 3*d* overlapping the contact position P1 between the crimp piece 3*b* and the cut end 1*c* of the conductor 1*a*. As a result, a larger contact load is applied to the conductor 1*a* and the crimp piece 3*b*.

On the other hand, when a projecting amount of the crimp piece 3*b* from the flat cable 1 is too large, the bent portion 3*e* of the crimp piece 3*b* does not overlap the contact position P2 between the crimp piece 3*b* and the cut end 1*c* of the conductor 1*a*. For this reason, the crimp piece 3*b* cannot involve the cut end 1*c* when its leading end is bent, resulting in a reduction in the contact load applied to the conductor 1*a* and the crimp piece 3*b*.

Such a difference in the connecting state between the flat cable 1 and the connecting terminal 3 can be confirmed in the following manner.

Ten flat cables 1 and ten connecting terminals 3 were prepared. Each flat cable 1 was approximately 0.35 mm in thickness with a conductor 1*a* of 0.15 mm in thickness and 2.5 mm in width Wc covered with an insulating material formed of a polyethylene terephthalate (PET) film. Each connecting terminal 3 was provided with crimp pieces 3*b* of approximately 2.3 mm long arranged on both sides in the width direction of a substrate 3*a* of 2.0 mm in width Wt.

For a set of five flat cables, the crimp pieces 3*b* were pierced into the conductor 1*a* with a gap G (=1.0 mm) left between the substrate 3*a* and flat cable 1, and the leading ends of the crimp pieces 3*b* were arcuately curved. For another set of five flat cables, the crimp pieces 3*b* were pierced into the conductor 1*a* without any gap between the substrate 3*a* and flat cable 1, and the leading ends of the crimp pieces 3*b* were arcuately curved. These two sets of flat cables 1 each connected with the connecting terminal were left at a high temperature (=100° C.) for 120 hours in consideration of use environments, and a contact resistance value between the conductor 1*a* and the connecting terminal 3 was measured for each flat cable after conducting a vibration test in which vibration is applied to the flat cable in three directions of front-rear, left-right, and up-down under conditions of 4.5 G, 20 Hz–200 Hz, and a sweeping time of 3 minutes. The result is shown in FIG. 9, where G1 shows when the gap G was left between the substrate 3*a* and flat cable 1, and G0 shows when no gap G was left.

Figure 9:
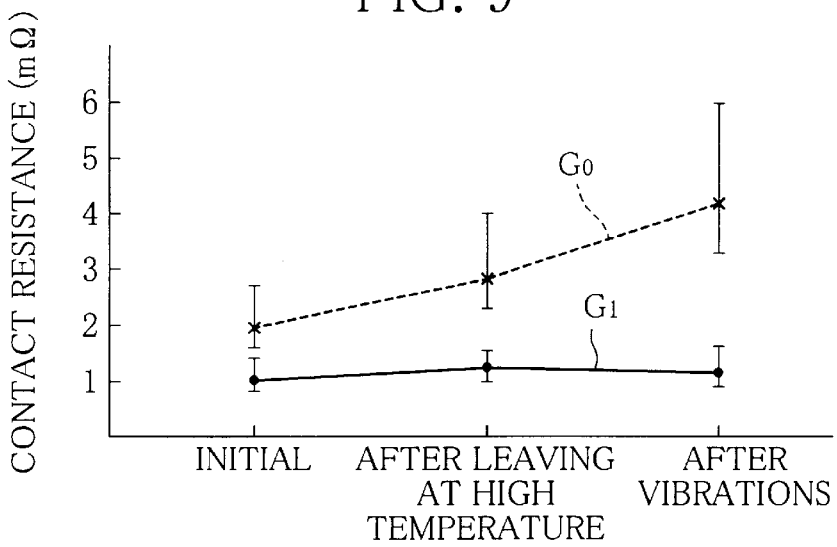
FIG. 9 is a graph showing a contact resistance of a conductor with a connecting terminal which is measured after a vibration test was conducted for a flat cable to which the connecting terminal is connected.

According to the result shown in FIG. 9, it was found that a change in contact resistance is smaller when the flat cable 1 was connected to the connecting terminal 3 by the method of the present invention with the gap G left between the substrate 3*a* and flat cable 1 (G1 in FIG. 9), as compared with the case where no gap was left (G0 in FIG. 9). This indicates that the present invention makes it possible to achieve a stable connection, without causing variations.

Next, the method of connecting a flat cable to a connecting terminal according to a second embodiment of the present invention will be described with reference to FIGS. 10 through 12.

Figure 10:
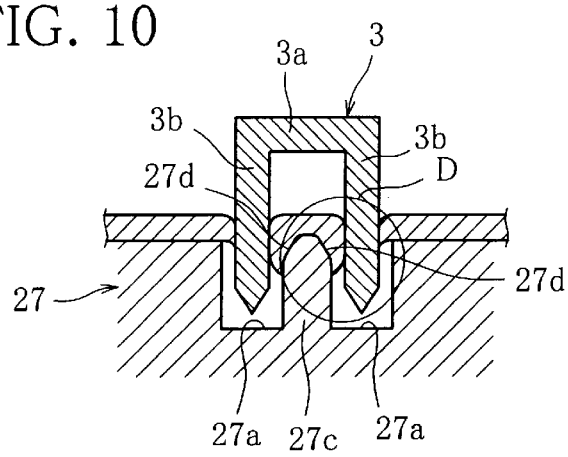
FIG. 10 is a cross-sectional view showing a receptacle for use in a method of connecting a flat cable to a connecting terminal according to a second embodiment of the present invention.

In a connecting apparatus 10 to which the connecting method of this embodiment is applied, a receptacle 27*a* shown in FIG. 10 is used in place of the receptacles 11, 25.

The receptacle 27 has a partition 27*c* formed with a pair of receiving grooves 27*a*, as shown in FIG. 10. The partition 27*c* is provided with pressurizing incline planes 27*d* at an entrance of receiving grooves 27*a*. As shown in FIG. 11, cut ends 1*c* are formed in a conductor 1*a* by means of the pressurizing incline planes 27*d* in cooperation with the crimp pieces 3*b* pierced into the conductor 1*a*. Each cut end 1*c* extends along the inner face of the crimp piece 3*b* and is in contact with the inner face of the crimp piece 3*b* with a constant contact pressure over substantially the entire length of the cut end. The pressurizing incline plane 27*d*, which is continuous to the receiving groove 27*a*, is formed by chamfering the ridge on the upper edge of the partition 27*c* into an arcuate surface. An inclination angle of the pressurizing incline plane 27*d* depends on the materials of the crimp piece 3*b* and conductor 1*a*, the shape of the crimp pieces 3*b*, the thickness of the conductor 1*a*, and the like, and is not uniquely determined.

Figure 11:
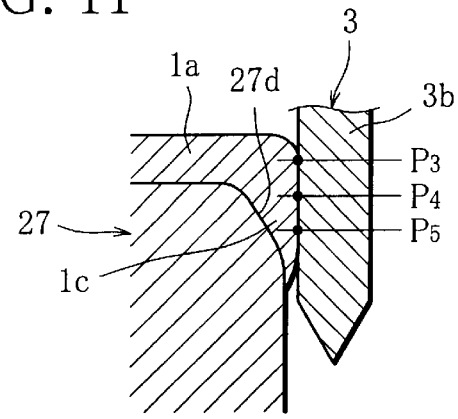
FIG. 11 is a cross-sectional view showing the relationship between a pressurized incline plane formed on the receptacle of FIG. 10, a conductor of a flat cable, and a crimp piece of a connecting terminal.

In FIGS. 10 and 11, only the conductor 1*a* of the flat cable 1 is shown, and the insulating material 1*b* is omitted.

In the connecting method of this embodiment, the receptacle 27 is used to pierce the crimp pieces 3*b* of the connecting terminal 3 into a desired conductor 1*a* of the flat cable 1. Due to the provision of the pressurizing incline planes 27*d* of the partition of the receptacle 27, the conductor 1*a* is formed with the cut ends 1*c* which extend along the inner faces of the crimp pieces 3*b*, as shown in FIG. 11, and which are in contact therewith over substantially the entire length thereof with a constant contact pressure. For instance, the cut end 1*c* is in contact with the crimp piece 3*b* at several points, e.g., three points P3 to P5. Contact pressures at these points P3 to P5 are the same from one another. Therefore, the connecting terminal 3 is connected to the flat cable 1 in a stable state, without causing variations in contact resistance.

Next, after the leading ends of the crimp pieces 3*b* penetrating the flat cable 1 are released from the receiving grooves 27*a*, the leading ends are bent and arcuately curved by a bending recess, not shown, while maintaining cut ends 1*c* in contact with the crimp pieces 3*b*, whereby the connecting terminal 3 is connected to the flat cable 1.

Therefore, according to the connecting method of this embodiment using the receptacle 27, the conductor 1*a* can be connected to the plurality of crimp pieces 3*b* in a stable state with less variations in contact resistance.

The connecting apparatus which embodies the connecting method of this embodiment uses the receptacle 27 having the pressurizing incline planes 27*d*. Thus, the cut ends 1*c* formed in the conductor 1*a* when the crimp pieces 3*b* are pierced there into can be brought into contact with the inner faces of the crimp pieces 3*b* with a constant contact pressure over substantially the entire length of the cut ends. Therefore, according to this embodiment, it is possible to provide a connecting apparatus for connecting the flat cable to the connecting terminal in a stable connecting state with less variations in contact resistance of the crimp pieces 3*b* to the conductor 1*a*.

This was confirmed by conducting a thermal shock test in which samples S1–S3 each having a flat cable connected to a connecting terminal were subject to 1,000 cycles of thermal shock in a range of +80° C. to −30° C.

Specifically, the sample S1 was fabricated in accordance with the method of this invention, in which a connecting terminal 3 having a substrate 3*a* of 2.1 mm in width Wt and a crimp piece 3*b* of 0.25 mm in thickness was connected to an insulation extruded type flat cable 1 having a conductor 1*a* of 0.15 mm in thickness and 2.5 mm in width Wc covered with an insulating material 1*b* made of a polybuthylene terephthalate film (PBT). The sample S2 was fabricated by connecting a flat cable 1 to a connecting terminal 3, which were the same kinds as those of sample S1, in accordance with the conventional method modified by shifting a position, at which a crimp piece 3*b* was pierced, from the center of the receiving groove 27*a* in the width direction of the groove. The sample S3 was fabricated by piercing the crimp pieces 3*b* into a flat cable 1 using a conventional receptacle other than the receptacle 27.

Figure 12:
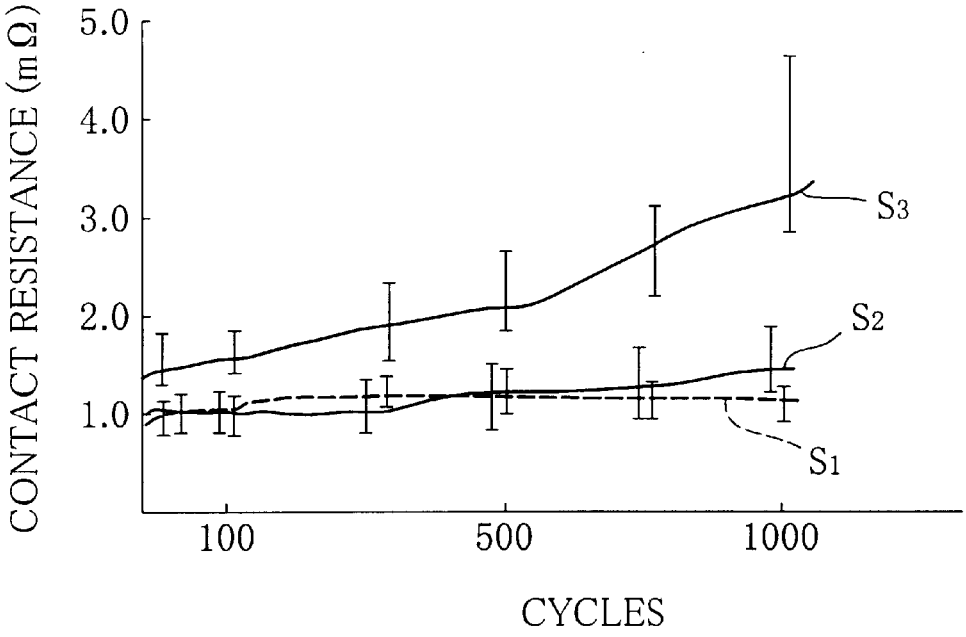
FIG. 12 is a graph showing the result of measurement on a contact resistance while a thermal shock test was conducted to a sample of a flat cable to which a connection terminal was connected.

The result of the test is shown in FIG. 12. As is apparent from FIG. 12, it is found that the use of the receptacle 27 is essential in the connecting method and the connecting apparatus 10 of this embodiment in order to provide a stable connecting state with less variations in contact resistance. Specifically, the sample S1 connected using the receptacle 27 shows a stable connecting state with less variations in contact resistance than the sample S2 based on the conventional method. Although the sample S1 uses the insulation extruded type flat cable 1, it shows stable performance, with less variations in contact resistance, equivalent or superior to the conventional flat cable which uses a polyethylene terephthalate (PET) film as the insulating material 1*b*.

Next, a method of determining a connecting state of the flat cable 1 to connecting terminal 5, connected using the connecting apparatus 10 shown in FIG. 1 based on the aforementioned connecting method, will be described with reference to FIGS. 13 through 16.

According to the findings of the present inventors, the connecting state of the conductor 1*a* to the crimp piece 5*b* when the flat cable 1 is connected to the connecting terminal 5, largely depends on a contact load (N) with which the cut end 1*c* of the conductor 1*a* is in contact with the crimp piece 5*b*. In other words, pass/fail of the connecting state of the conductor 1*a* to the crimp piece 5*b* largely depends on a resistive load (N) observed after through-holes extending through the conductor 1*a* are formed by piercing the crimp pieces 5*b* into the flat cable 1.

The connecting apparatus 20 is configured to create a load change characteristic diagram when the crimp pieces 5*b* are pierced into the flat cable 1, with the horizontal axis representing a displacement amount (mm) of the crimp pieces and the vertical axis representing the load (N) acting on the crimp pieces, based on electric signals related to a load and a displacement amount input from the load cell 17*b* of the second elevating press 17 and the displacement mount sensor 18.

Figure 13:
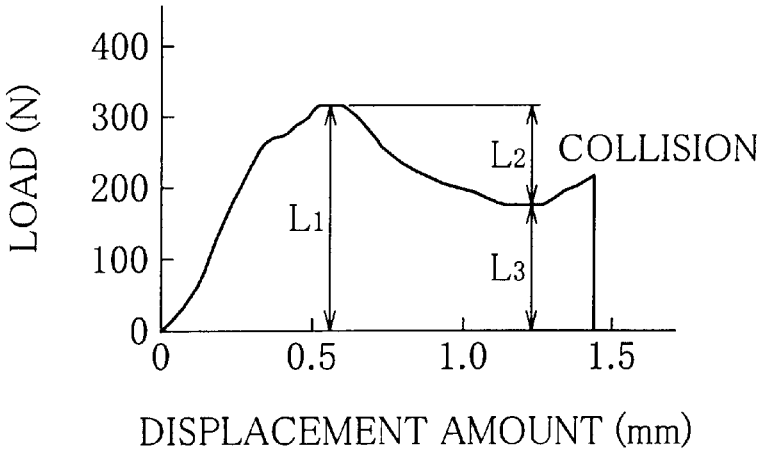
FIG. 13 is a load change characteristic diagram showing the relationship between a load acting on a crimp piece and a displacement amount of the crimp piece in a normal state in which the crimp piece is properly pierced into a flat cable.

FIG. 13 shows the load change characteristic created by the connecting apparatus 20 in a normal state in which the crimp pieces 5*b* of the connecting terminal 5 having the substrate 5*a* with a width Wt=1.2 mm are properly pierced into the flat cable 1 having the conductor 1*a* with a thickness of 0.15 mm and a width Wc=1.5 mm.

In FIG. 13, with the increase in displacement of the crimp pieces 5*b*, the load acting on the crimp pieces increases to a maximum load L1 required for the crimp pieces 5*b* to penetrate through the entire flat cable 1, and then decreases to a minimum load L3 which corresponds to a friction resistance between the crimp pieces 5*b* and the conductor 1*a*. A difference L2 between the maximum load L1 and the load varying depending on the displacement of the crimp pieces represents a piercing load, i.e., a load of a resistance associated with the formation of openings in the conductor 1*a* by means of the crimp pieces 5*b*.

A thermal shock test for a flat cable connected with a connecting terminal reveals that the crimp pieces 5*b* can be connected to the conductor 1*a* under a stable contact load when the piercing load L2 has a value equal to or less than a buckle threshold value of the crimp pieces 5*b*.

Figures 14A, 14B:
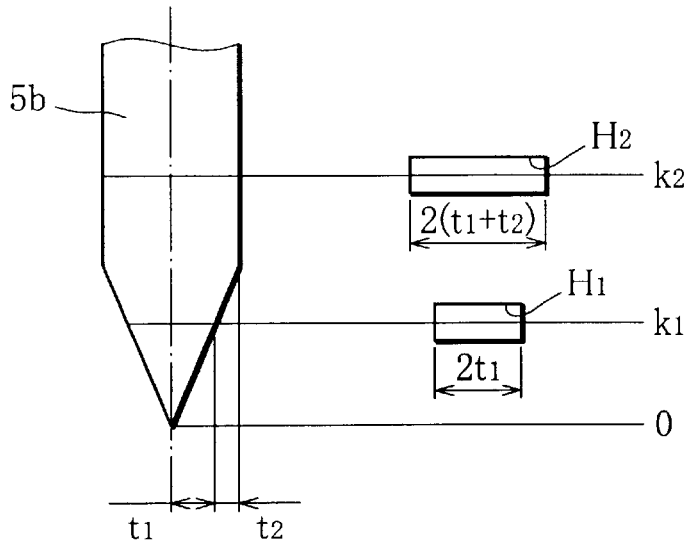
FIGS. 14A and 14B are model diagrams showing positional relationships between an opening formed in a conductor of a flat cable, a crimp piece, and the conductor.

In FIGS. 14A and 14B, with the downward movement of the connecting terminal 5, a relative position of a conductor 1*a* and a crimp piece 5*b* of a connecting terminal 5 changes. When a relative position K1 is assumed, an opening H1 having a width of 2t1 is formed in the conductor 1*a*. As the connecting terminal 5 is further moved down, the width of the opening in the conductor gradually increases. When the tapered portion of the crimp piece 5*b* passes through the entire conductor 1*a*, an opening H2 having a width of 2(t1+t2) is formed. Subsequently, the width 2(t1+t2) of the opening is kept unchanged although the connecting terminal 5 is further moved downward. Symbol K2 denotes, by way of example, a relative position of the conductor 1*a* and the crimp piece 5*b* after the tapered portion passes through the conductor.

In actually connecting the flat cable 1 to the connecting terminal 5, the piercing load L2 is determined and compared with a normal piercing load serving as the criteria to determine a connecting state. The normal piercing load, which is determined in advance during the fabrication of non-defective products, varies in a range from 150N to 220N, for instance. Thus, pass/fail of a connecting state is determined by making a determination as to whether or not the piercing load L2 determined during the actual connecting operation falls with in a range, e.g., from 150N to 220N.

Figure 15:
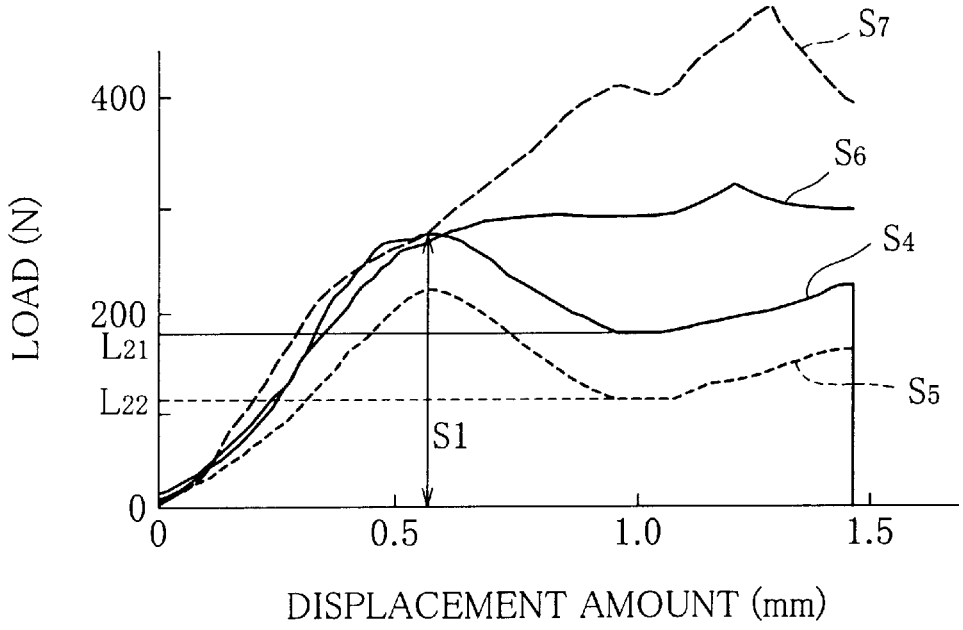
FIG. 15 is a load change characteristic diagram of a measured piercing load to a displacement amount of a crimp piece in a variety of samples of a flat cable to which a connecting terminal is connected.

FIG. 15 is a load change characteristic diagram of a measured piercing load to a displacement amount of the crimp pieces 5*b* in a variety of samples S4 to S7.

The sample S4 is an actually measured result in the normal state described in connection with FIG. 13, where the piercing load L21 is approximately 180N.

Figure 16:
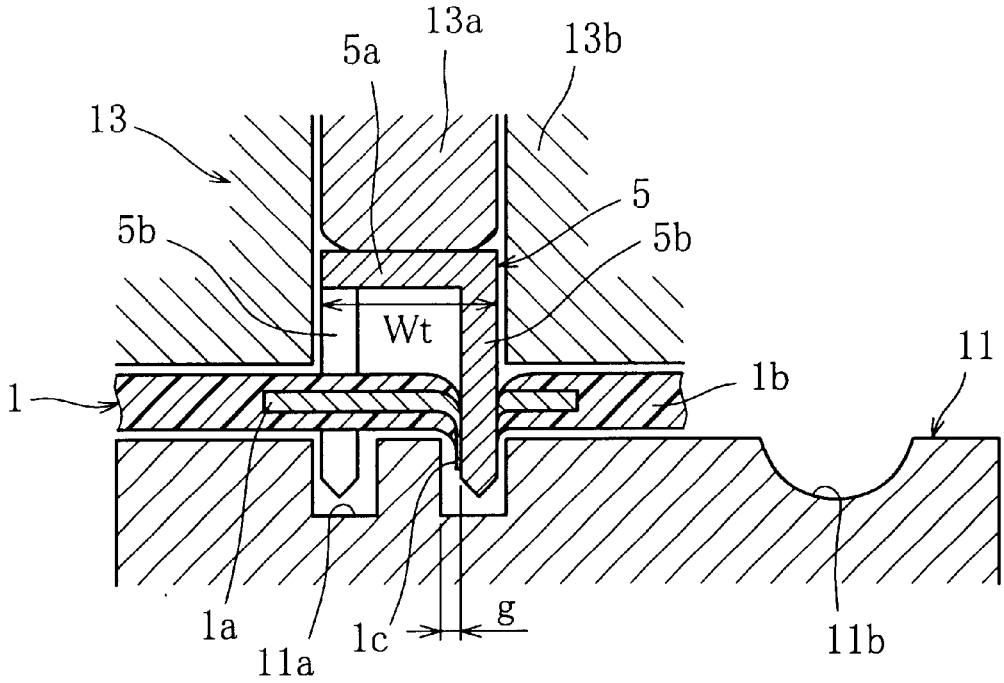
FIG. 16 is a cross-sectional view for explaining a gap between a crimp piece and a receiving groove of a receptacle.
Figure 17:
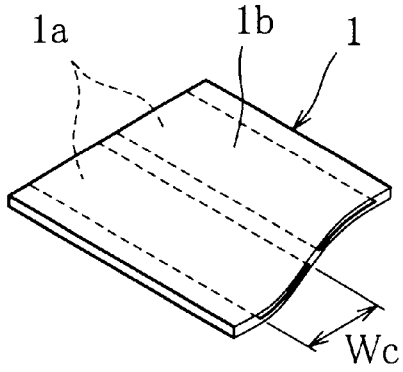
FIG. 17 is a perspective view of a flat cable.

The sample S5 is an actually measured result in a defective state, where the piercing load is L22. Here, the defective state may be, for example, the crimp pieces 5*b* not properly inserted into the receiving grooves 11*a*, or the crimp pieces 5*b* pierced into the flat cable 1 with a gap g between crimp pieces 5*b* and partition 11*c* larger than normal, as shown in FIG. 16. When the gap g is larger than normal, a contact load between the cut end 1*c* of the conductor 1*a* and the crimp piece 5*b* is reduced.

The sample S6 is an actually measured result when a residue of the insulating material 1*b* or foreign substances clog between the receiving grooves 11*a* and flat cable 1 to cause an abnormally large contact load between the crimp pieces 5*b* and the cut end 1*c* of the conductor 1*a*.

The sample S7 is an actually measured result when the crimp pieces 5*b* cannot penetrate the flat cable 1 and are buckled due to foreign substances introduced into the receiving grooves 11*a*, defective receiving grooves 11*a*, defective thicknesses of the conductor 1*a* and insulating material 1*b*, and the like.

In this way, a variety of defective states which could occur in connecting the flat cable 1 to the connecting terminal 5 can be simply detected based on the piercing load change characteristic to a displacement amount of the crimp pieces 5*b*. Therefore, by comparing such cases with the normal state with respect to the piercing load, it is possible to quite easily determine a connecting state of the flat cable 1 to the connecting terminal 5.

When the pair of receiving grooves 11*a* wear, a measured piercing load changes. Therefore, in the connecting state determining method of this embodiment, it is also possible to determine the wear of the receiving grooves 11*a*, and hence the lifetime of the receptacle 11 based on a change in this load.

While the connecting state determining method of this embodiment has been described in connection with the connecting terminal 5, a similar determination can be made as well when the connecting terminal 3 is used.

What is claimed is:

1. A method of connecting a flat cable to a connecting terminal, in which the flat cable having a plurality of flat conductors, arranged in parallel and having surfaces thereof covered with an insulating material, is connected to the connecting terminal, by piercing a plurality of crimp pieces, formed integrally with a substrate of the connecting terminal, into a desired conductor of the flat cable and by inwardly bending leading ends of the crimp pieces penetrating the flat cable to hold the desired conductor therebetween, comprising the steps of:

piercing the crimp pieces into the desired conductor with a gap left between the substrate and the flat cable; and bending the leading ends of the crimp pieces while maintaining a contact position unchanged at which each of the crimp pieces penetrating the conductor is in contact with the conductor.

2. The method according to claim 1, wherein the crimp pieces are urged simultaneously from the substrate and from the leading ends of the crimp pieces when the leading ends are bent.

3. The method according to claim 1, wherein an urging force for urging the substrate is set to be larger than an urging force for urging the leading ends of the crimp pieces.

4. A method of connecting a flat cable to a connecting terminal, in which the flat cable, having a plurality of flat conductors arranged in parallel and having surfaces thereof covered with an insulating material, is connected to the connecting terminal, by piercing a plurality of crimp pieces, formed integrally with a substrate of the connecting terminal, into a desired conductor of the flat cable and by inwardly bending leading ends of the crimp pieces penetrating the flat cable to hold the desired conductor therebetween, comprising the step of:

forming cut ends in the desired conductor by means of the plurality of crimp pieces pierced into the desired conductor, each cut end extending along an inner face of a corresponding one crimp piece and in contact with the inner face with a constant contact pressure over substantially the entire length of the cut end.

5. A method of connecting a flat cable to a connecting terminal, in which the flat cable, having a plurality of flat conductors arranged in parallel and having surfaces thereof covered with an insulating material, is connected to the connecting terminal, by piercing a plurality of crimp pieces, formed integrally with a substrate of the connecting terminal, into a desired conductor of the flat cable and by inwardly bending leading ends of the crimp pieces penetrating the flat cable to hold the desired conductor therebetween, comprising the steps of:

forming cut ends in the desired conductor by means of the plurality of crimp pieces pierced into the desired conductor, each cut end extending along an inner face of a corresponding one crimp piece and in contact with the inner face with a constant pressure over substantially the entire length of the cut end; and inwardly bending the leading ends of the crimp pieces penetrating the flat cable, while maintaining a contact state of the cut ends with the crimp pieces unchanged.

6. A connecting state determining method for determining a connecting state of a connecting terminal to a flat cable having a plurality of flat conductors arranged in parallel and having surfaces thereof covered with an insulating material, in which the connecting state is determined when a desired conductor of the flat cable is connected to the connecting terminal by piercing a plurality of crimp pieces formed integrally with a substrate of the connecting terminal into the desired conductor and by inwardly bending leading ends of the crimp pieces penetrating the flat cable to hold the desired conductor therebetween, comprising the step of:

determining the connecting state of the crimp pieces to the desired conductor by comparing a piercing load determined when the crimp pieces are pierced into the flat cable and a normal piercing load determined in advance and observed when crimp pieces are normally pierced into a flat cable.

7. The connecting state determining method according to claim 6, wherein the piercing load is determined based on a difference between a maximum load and a minimum load acting on the crimp pieces measured when the crimp pieces are pierced into the flat cable, the minimum load being measured after the maximum load is reached.

* * * * *